US007758002B2

(12) United States Patent
Blackburn

(10) Patent No.: US 7,758,002 B2
(45) Date of Patent: Jul. 20, 2010

(54) ADJUSTABLE MOUSE SUPPORT

(75) Inventor: Nicholas L. Blackburn, Wellesley (CA)

(73) Assignee: CompX International Inc.

( * ) Notice: Subject to any disclaimer, the term of this patent is extended or adjusted under 35 U.S.C. 154(b) by 0 days.

(21) Appl. No.: 12/333,054

(22) Filed: Dec. 11, 2008

(65) Prior Publication Data

US 2009/0166496 A1 Jul. 2, 2009

Related U.S. Application Data

(60) Provisional application No. 61/017,268, filed on Dec. 28, 2007.

(51) Int. Cl.
*E04G 3/00* (2006.01)

(52) U.S. Cl. ..... 248/278.1; 248/276.1

(58) Field of Classification Search ..... 248/278.1, 248/276.1, 918
See application file for complete search history.

(56) References Cited

U.S. PATENT DOCUMENTS 5,876,002 A 3/1999 White et al.
6,086,034 A 7/2000 McAllister et al.
6,109,571 A * 8/2000 Hirschovits et al. ..... 248/118
6,347,771 B1 * 2/2002 Lauzon et al. ..... 248/118
6,668,563 B2 12/2003 Mirowsky et al.
6,769,657 B1 * 8/2004 Huang ..... 248/278.1
7,147,190 B2 * 12/2006 Welles et al. ..... 248/229.16
7,159,827 B2 * 1/2007 Bombelli ..... 248/118.1
2004/0195482 A1 * 10/2004 Kollar et al. ..... 248/282.1
2006/0103180 A1 * 5/2006 Brown ..... 297/162

* cited by examiner

*Primary Examiner*—Ramon O Ramirez
(74) *Attorney, Agent, or Firm*—Daryl W. Schnurr

(57) ABSTRACT

An adjustable mouse support for use with a base is provided with an elongated member, a mounting member, a bracket and a platform. The elongated member has a first pivot axis with the mounting member and a second pivot axis with the bracket. The mounting member and the bracket are located at opposite sides of the elongated member. The platform is pivotally mounted to the bracket about a third pivot axis. The first and second pivot axes are parallel to one another and allow for rotation of the elongated member and the bracket within a vertical plane. The third pivot axis is perpendicular to the first and second pivot axes and allows for rotation of the platform within a horizontal plane. The first pivot axis can be locked.

20 Claims, 11 Drawing Sheets

ADJUSTABLE MOUSE SUPPORT

Applicant claims the benefit of U.S. Provisional Application Ser. No. 61/017,268 filed on Dec. 28, 2007

BACKGROUND OF THE INVENTION

1. Field of the Invention

This invention relates to computer mouse supports, and in particular to an adjustable mouse support for use with a base, having height and tilt adjustments, which assist a user in achieving proper ergonomic alignment of a computer mouse with the user's wrist and hand.

2. Detailed Description of the Prior Art

Frequent and extensive use of a computer mouse is known to cause repetitive strain injury, a group of conditions affecting the muscles, tendons and nerves in the hands and arms. It is also known that good ergonomics can help prevent or halt the progress of the disorder. While various devices have been invented for the purpose of improving the ergonomics of computer mouse use, these devices can be too cumbersome, unduly complicated, uncomfortable, only allow for horizontal adjustment, do not support a range of use positions, and generally make it difficult for a user to achieve proper ergonomic alignment of a mouse with the user's wrist and hand.

The Lauzon et al. U.S. Pat. No. 6,347,771 discloses a portable arm and mouse support to be affixed to a desk proximal the keyboard of a computer. The Hirschovits et al. U.S. Pat. No. 6,109,571 describes a mouse support with a U-shaped attachment part for attaching the support to a tabletop.

The White et al. U.S. Pat. No. 5,876,002 describes an arm and mouse support for attachment to the front overhang of a desktop. The Waxham et al. U.S. Pat. No. 6,668,563 discloses a support for mounting a mouse surface on a keyboard supporting tray. The Bombelli U.S. Pat. No. 7,159,827 discloses an arm support with mouse pad having a clamp for mounting the support to a desk. A support structure can be rotated 360 degrees around a vertical axis of the clamp. The McAllister et al. U.S. Pat. No. 6,086,034 describes an independently adjustable mouse pad mounted on a keyboard support.

SUMMARY OF THE INVENTION

It is an object of the present invention to provide an adjustable mouse support for use with a base, having easy to use height and tilt adjustments which assist a user in achieving proper ergonomic alignment of a computer mouse with the user's wrist and hand.

It is a further object of the present invention to provide an adjustable mouse support for use with a base which offers adjustability of the mousing surface about vertical and horizontal axes.

It is still a further object of the present invention to provide an adjustable mouse support for use with a base which comfortably supports an infinite range of mousing positions.

It is another object of the present invention to provide an adjustable mouse support which, when not in use, can be easily stored beneath a work surface without unclamping the support from a base to which it is affixed.

It is yet another object of the present invention to provide an adjustable mouse support which accommodates both left and right hand mouse users.

An adjustable mouse support is used with a base, the mouse support comprising an elongated member, a mounting member, a bracket and a platform. The elongated member has two ends with two pivot axes thereon, the two pivot axes being a first pivot axis located near a first end of the two ends and a second pivot axis located near a second end of the two ends. The mounting member is removably connectable to the base and pivotally connected to the elongated member at the first pivot axis. The bracket is pivotally connected to the elongated member at the second pivot axis. The mounting member and the bracket are located at opposite sides of the elongated member. The mouse platform is pivotally mounted on the bracket about a third pivot axis, the first and second pivot axes being parallel to one another. The third pivot axis is perpendicular to the first and second pivot axes.

The mounting member preferably has a clamp for engagement with a base and a face portion located opposite the clamp, the face portion having a plurality of peripherally spaced arcuate notches about the circumference thereof. At the first pivot axis, the mounting member is pivotally connected to the elongated member and is held in place by a pivot screw. At the second pivot axis, a bolt extends through a second aperture of the elongated member and into the bracket. The bolt has a head which is surrounded by a coil spring and cap. The cap is sized to fit within an arcuate notch of the mounting member. When the cap is depressed, the spring compresses and the cap moves toward the bracket, which unlocks the first elongated member and allows the elongated member to rotate relative to the mounting member about the first pivot axis. To lock the elongated member relative to the mounting member so that the elongated member cannot pivot about the first pivot axis, pressure on the cap is released, which causes the spring to unload and forces the cap back to its resting position within an arcuate notch of the mounting member. The elongated member can only be pivoted to correspond to prefixed positions of the notches so that the cap will rest within a notch when the cap is released. The presence of the cap within a notch locks the elongated member in position along the first pivot axis relative to the mounting member. At the third pivot axis, a bolt rotatably secures the mouse supporting platform to the bracket.

An adjustable mouse support is used with a base, the mouse support comprising an elongated member, a mounting member, a bracket and a platform. The elongated member has two ends with two pivot axes thereon, the two pivot axes being a first pivot axis located near a first end of the two ends, and a second pivot axis located near a second end of the two ends. The mounting member is removably connectable to the base, and is pivotally connected to the elongated member at the first pivot axis. The bracket is pivotally connected to the elongated member at the second pivot axis, the first pivot axis and the second pivot axis being parallel to one another. The platform is pivotally connected to the bracket about a third pivot axis, the elongated member and the bracket being sized so that the platform can pivot through a vertical plane between the bracket and the elongated member.

DETAILED DESCRIPTION OF A PREFERRED EMBODIMENT

Figure 1:
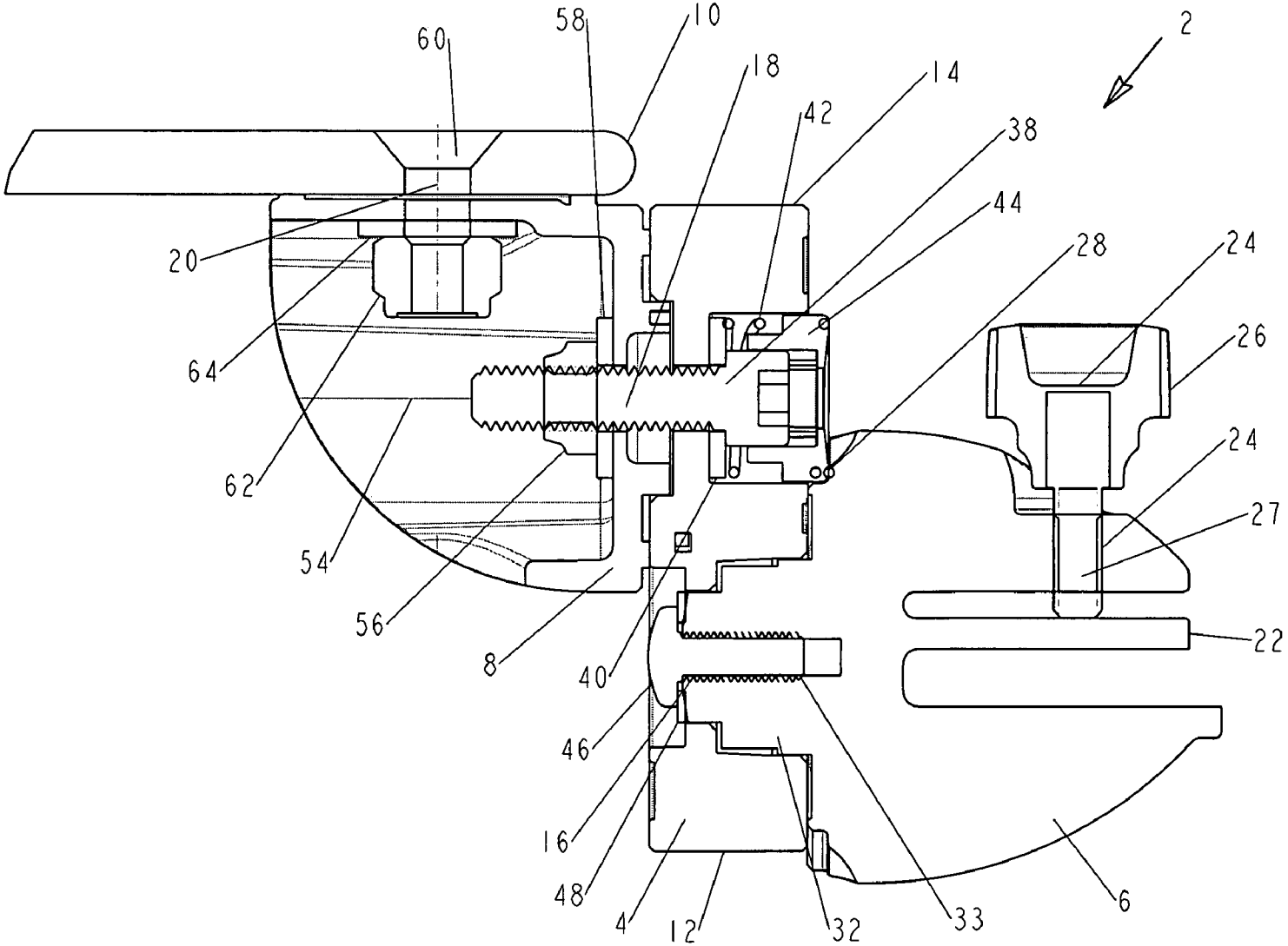
FIG. 1 is a sectional side view of a mouse support of the present invention.
Figure 2:
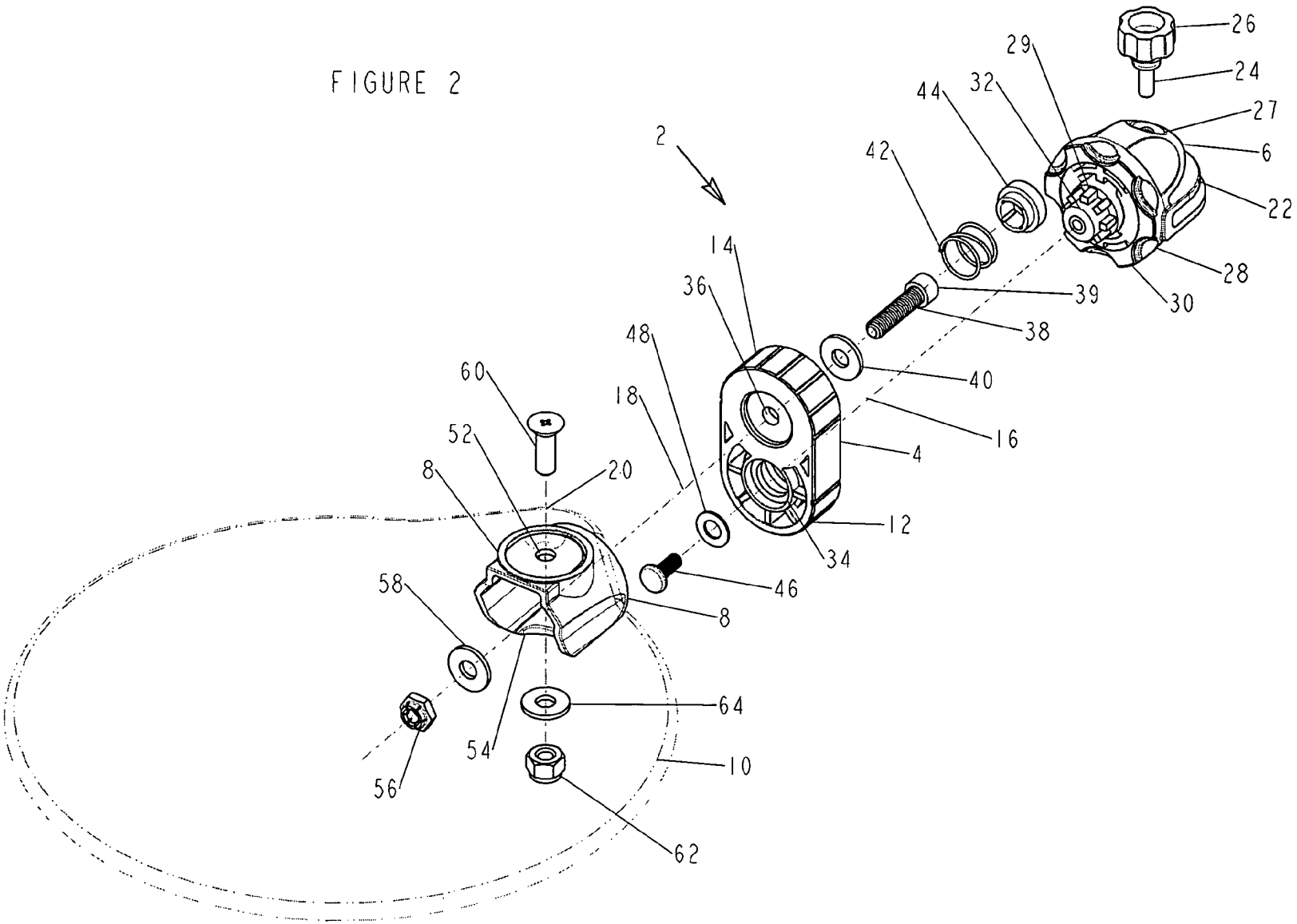
FIG. 2 is an exploded perspective view of the mouse support.

Referring to FIGS. 1 and 2, an adjustable mouse support 2 is used with a base (not shown) in accordance with the preferred embodiment of the present invention. Preferably, the base is a keyboard tray. The mouse support 2 has an elongated member 4, a mounting member 6, a bracket 8 and a platform 10. The elongated member 4 has a first end 12 and a second end 14, with two pivot axes thereon, a first pivot axis 16 located near said first end 12 and a second pivot axis 18 located near said second end 14. The mounting member 6 is removably connectable to the base (not shown) and is pivotally connected to the elongated member 4 at the first pivot axis 16. The bracket 8 is pivotally connected to the elongated member 4 at the second pivot axis 18. The mounting member 6 and bracket 8 are located at opposite ends of the elongated member 4. The platform 10 is pivotally connected to the bracket 8 about a third pivot axis 20. The first and second pivot axes 16, 18 are parallel to one another, while the third pivot axis 20 is perpendicular to the first and second pivot axes 16, 18. The first pivot axis has a locked position and an unlocked position.

In FIG. 2, the mounting member 6 has a clamp 22 for engagement with the base (not shown), and a first aperture 27 for receiving a clamping bolt 24. The clamping bolt 24 is inserted within said first aperture 27 and rotatable therein by turning a clamping nut 26. A circular face 29 is distally located from said clamp 22, said face 29 comprising a plurality of peripherally spaced arcuate notches 28 about a circumference of said face 29. The arcuate notches 28 are separated by a series of spacers 30. The face 29 further has a cylindrical portion 32 located substantially at the centre of the face 29, said cylindrical portion 32 comprising a second aperture 33 for receiving a first pivot screw 46. The face 29 is adjacent to the elongated member 4 and is centered on the first pivot axis 16.

In FIG. 2, the elongated member 4 has a first aperture 34 located substantially at said first end 12 of the elongated member 4 and a second aperture 36 located substantially at said second end 14. The first aperture 34 has a slightly larger size than the cylindrical portion 32 of the mounting member 6. The cylindrical portion 32 is inserted within the first aperture 34 and pivotally connects to the elongated member 4 via insertion of a first pivot screw 46 and washer 48 through the first elongated aperture 34 and into the second aperture 33. The elongated member 4 is then rotatable about the mounting member 6 at the first pivot axis 16.

As illustrated in FIGS. 1 and 2, the second aperture 36 of the elongated member 4 is sized to receive a bolt 38 and washer 40. The bolt 38 contains a head 39 which is surrounded by a coil spring 42. A cap 44 is sized and shaped to cover the head 39 of the bolt 38 and the spring 42. The cap 44 is sized and shaped to fit within one of a plurality of arcuate notches 28 of the mounting member 6. When the cap 44 is depressed, the spring 42 compresses and the cap 44 moves within the second aperture 36 of the elongated member 4 and clear of the notch 28 in which it had been located, which in turn allows the elongated member 4 to rotate relative to the mounting member 6 about the first pivot axis 16. When the elongated member 4 is unlocked, the elongated member 4 is capable of rotating about the mounting member 6 at about the first pivot axis 16. In order to lock the elongated member so that it is unable to pivot relative to the mounting member about the first pivot axis 16, pressure applied to the cap 44 is released, which forces the cap 44 back to a resting position within one of the arcuate notches 28 of the mounting member 6. The spacers 30 prevent the cap 44 from sliding out of the notch 28. The cap 44 is spring-loaded and the spring 42 is located between the cap 44 and the head 39. The cap is a movable projection that fits within each of the notches, one notch at a time. The cap is depressible against a force of the spring 42 toward the elongated member to unlock the elongated member so that the elongated member 4 can pivot relative to the mounting member about the first pivot axis 16. The elongated member 4 is locked relative to the mounting member 6 and is prevented from rotating about the first pivot axis 16 when the spring is in an unloaded position such that the cap rests within one of the notches.

At the second pivot axis 18, the bolt 38 extends through the second aperture 36 of the elongated member 4 and into a first aperture 50 (not shown in FIG. 1 or 2) of the bracket 8. The bracket 8 is rotatable about the second pivot axis 18 around the elongated member 4. The bolt 38 is held in position by a nut 56 and washer 58.

At the third pivot axis 20, a bolt 60 protrudes through a second aperture 52 of the bracket 8 to secure the platform 10 to the bracket 8. The bolt 60 is held in position by a nut 62 and washer 64. Once secured, the platform 10 is rotatable about the third pivot axis 20 around the bracket 8. If desired, a user can maintain the platform in a substantially horizontal plane by pivoting the bracket about the second pivot axis when, or after, the elongated member is pivoted about the first pivot axis. The height of the platform will change relative to the mounting member as the elongated member is pivoted about the first pivot axis.

Figure 3A:
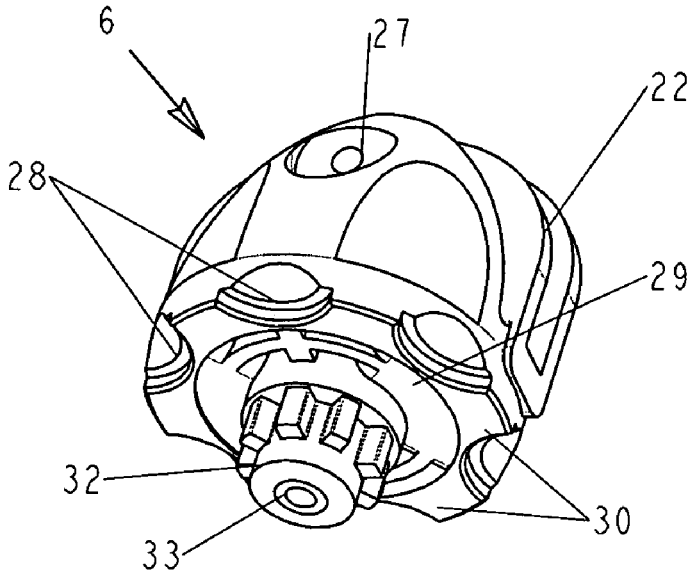
FIG. 3A is a perspective view of a mounting member.
Figure 3B:
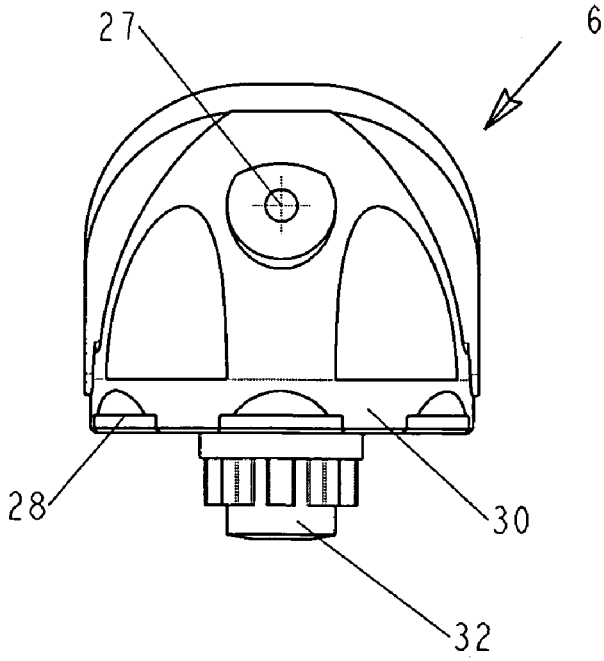
FIG. 3B is a top view of the mounting member.
Figure 3C:
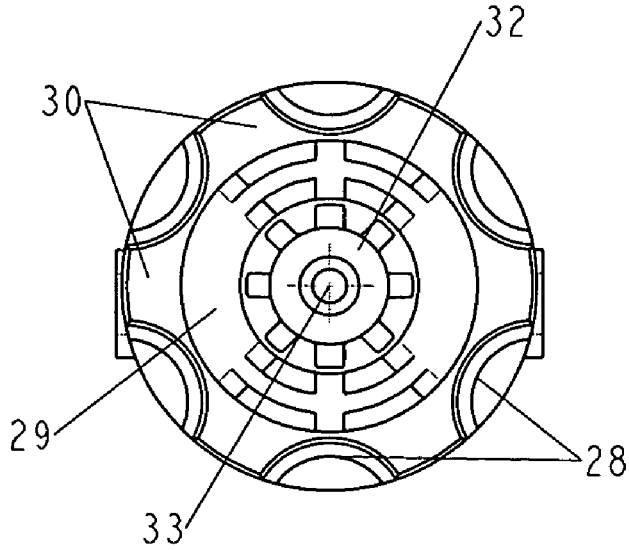
FIG. 3C is a front view of the mounting member.
Figure 3D:
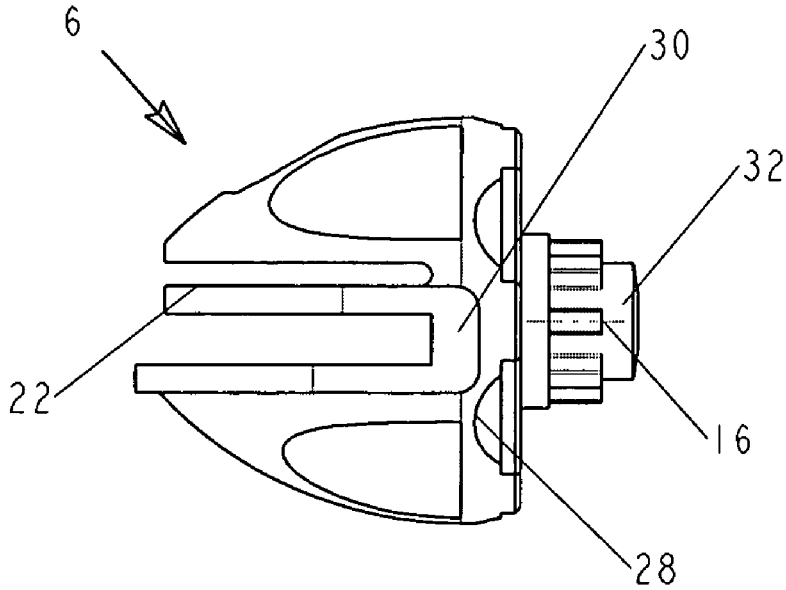
FIG. 3D is a side view of the mounting member.
Figure 3E:
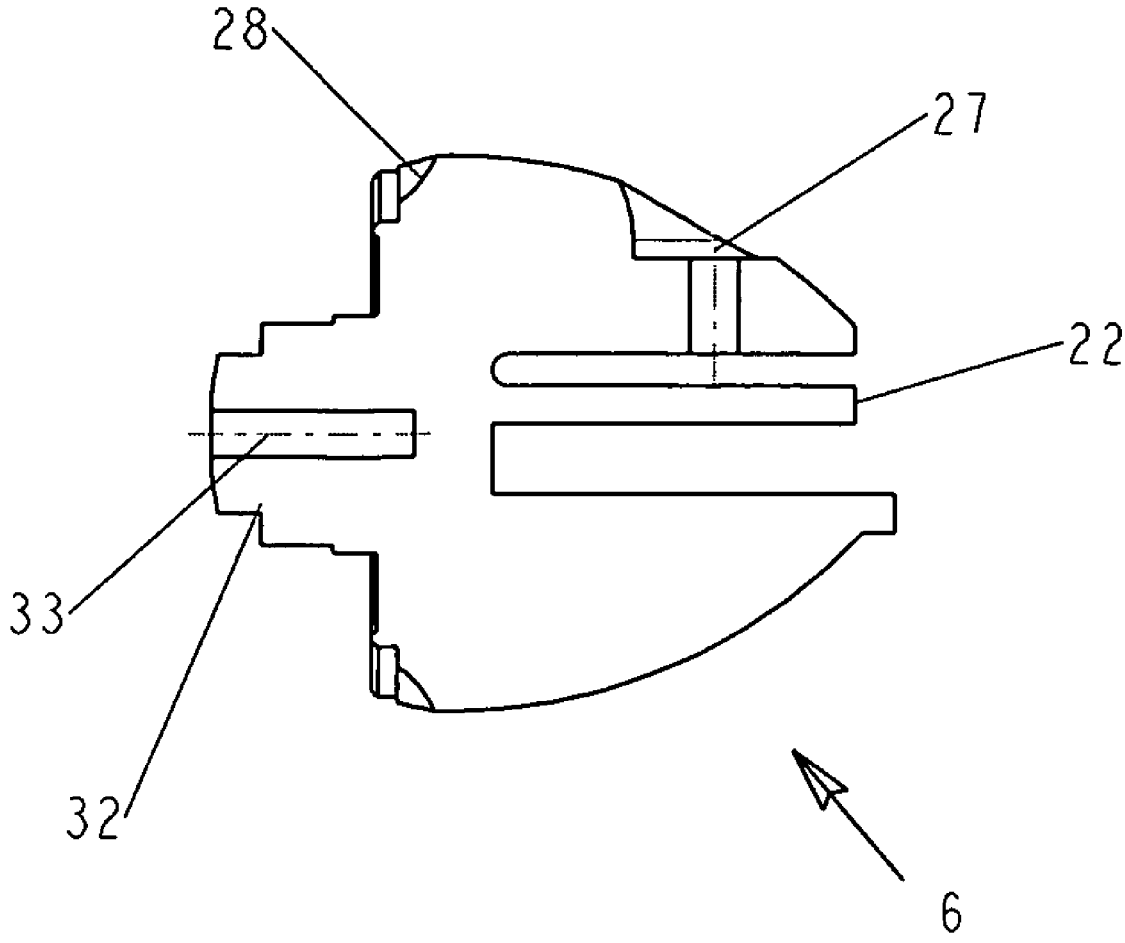
FIG. 3E is a sectional side of the mounting member from a side opposite to that shown in FIG. 3D.
Figure 4A:
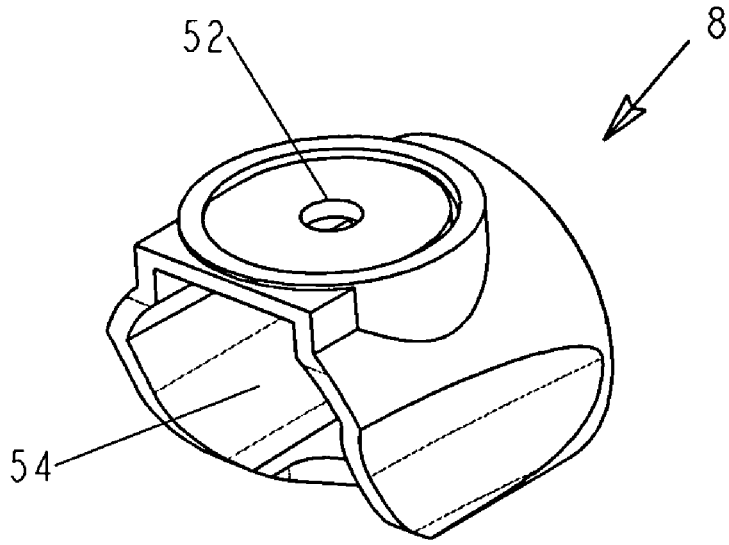
FIG. 4A is a perspective view of a bracket when viewed from a side opposite to an elongated member.
Figure 4B:
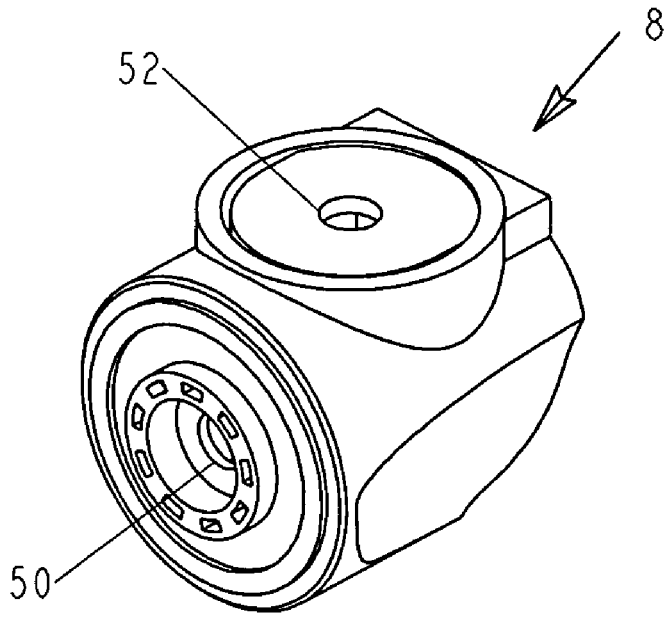
FIG. 4B is a perspective view of the bracket when viewed from a side to which the elongated member is connected.
Figure 4C:
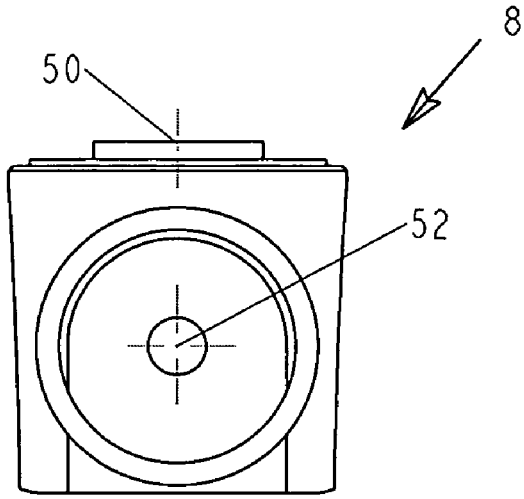
FIG. 4C is a top view of the bracket.
Figure 4D:
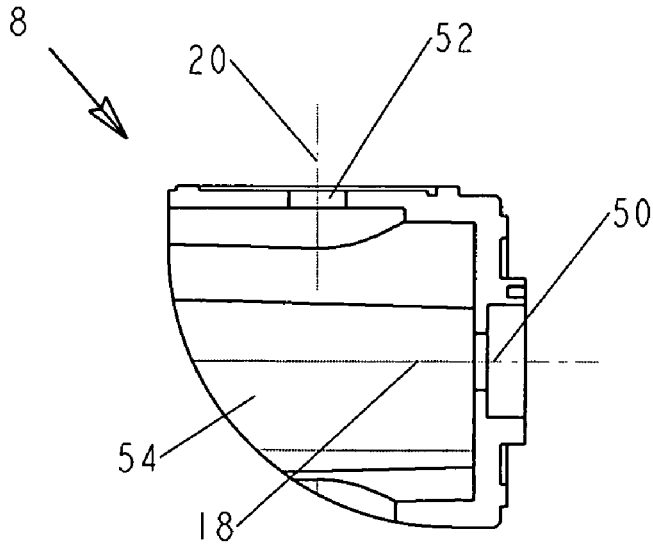
FIG. 4D is a sectional side view of the bracket.
Figure 4E:
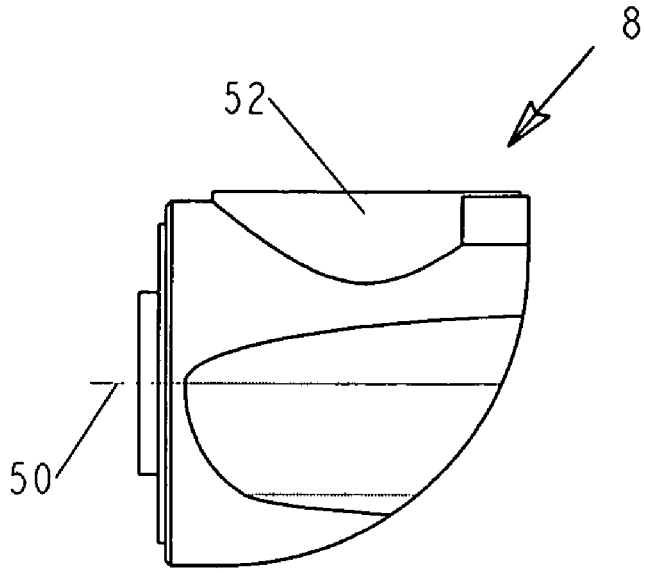
FIG. 4E is a side view of an opposite side of bracket to that shown in FIG. 4D.
Figure 4F:
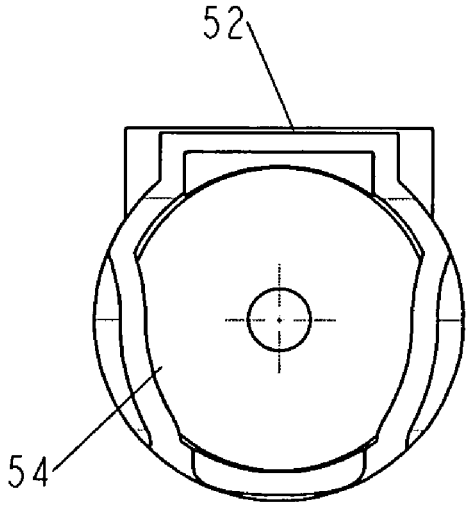
FIG. 4F is an end view of the bracket.
Figure 5A:
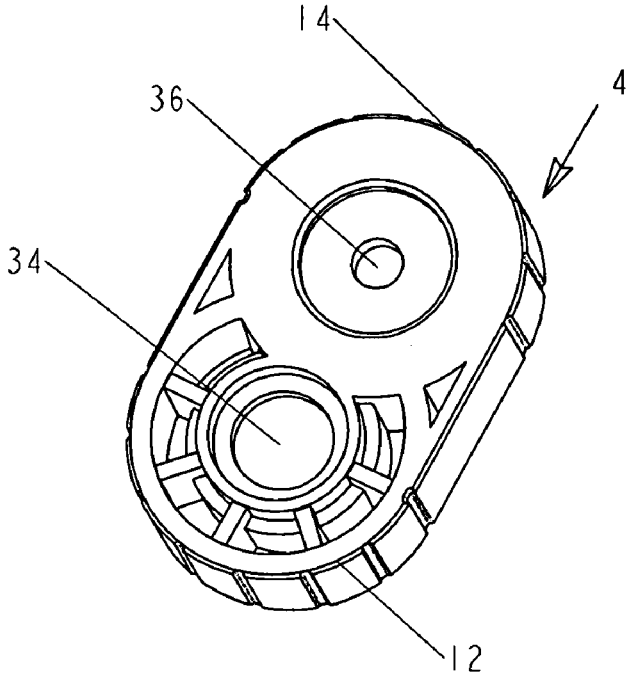
FIG. 5A is a perspective view of one side of the elongated member.
Figure 5B:
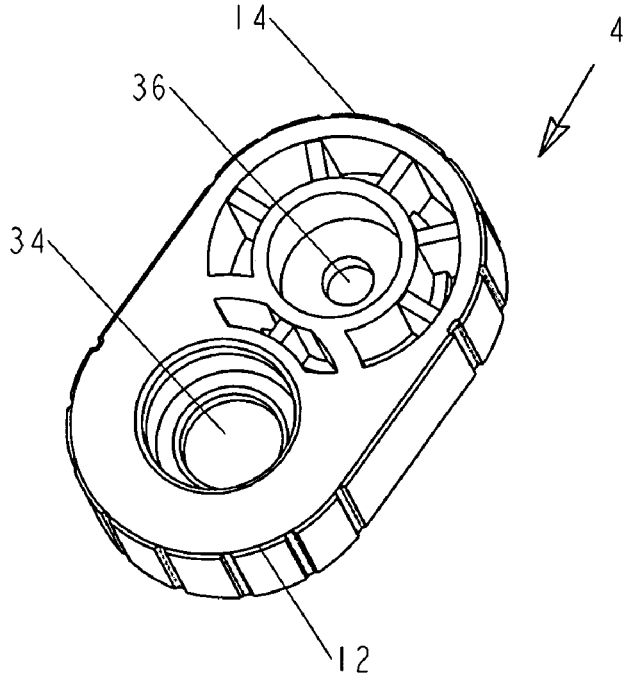
FIG. 5B is a perspective view of an opposite side of the elongated member.
Figure 5C:
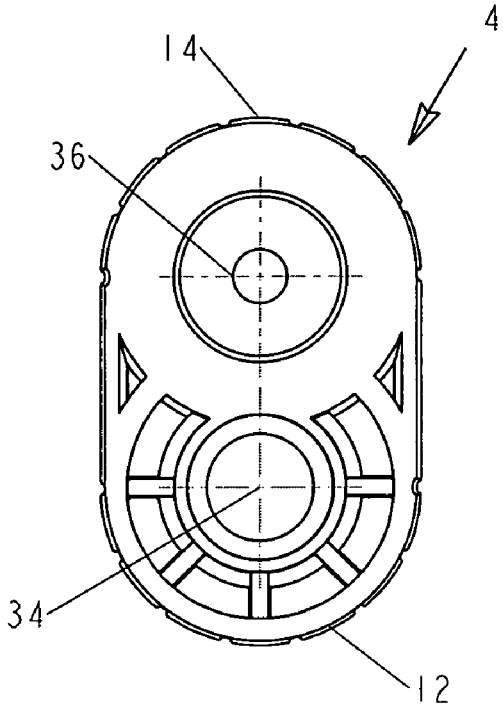
FIG. 5C is a side view of the elongated member.
Figure 5D:
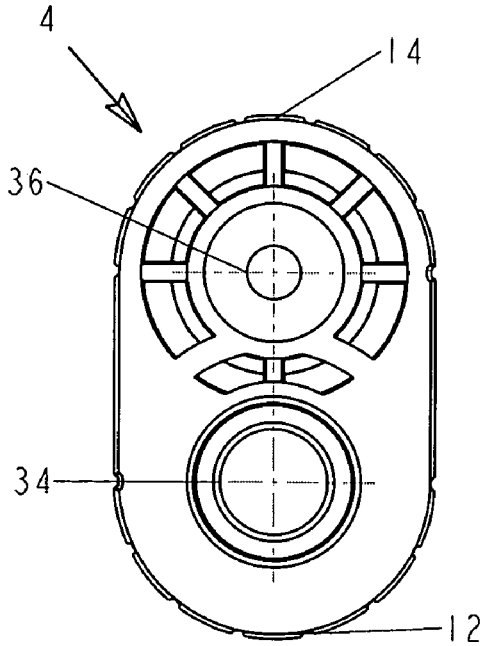
FIG. 5D is a side view of an opposite side of the elongated member to that shown in FIG. 5C.
Figure 5E:
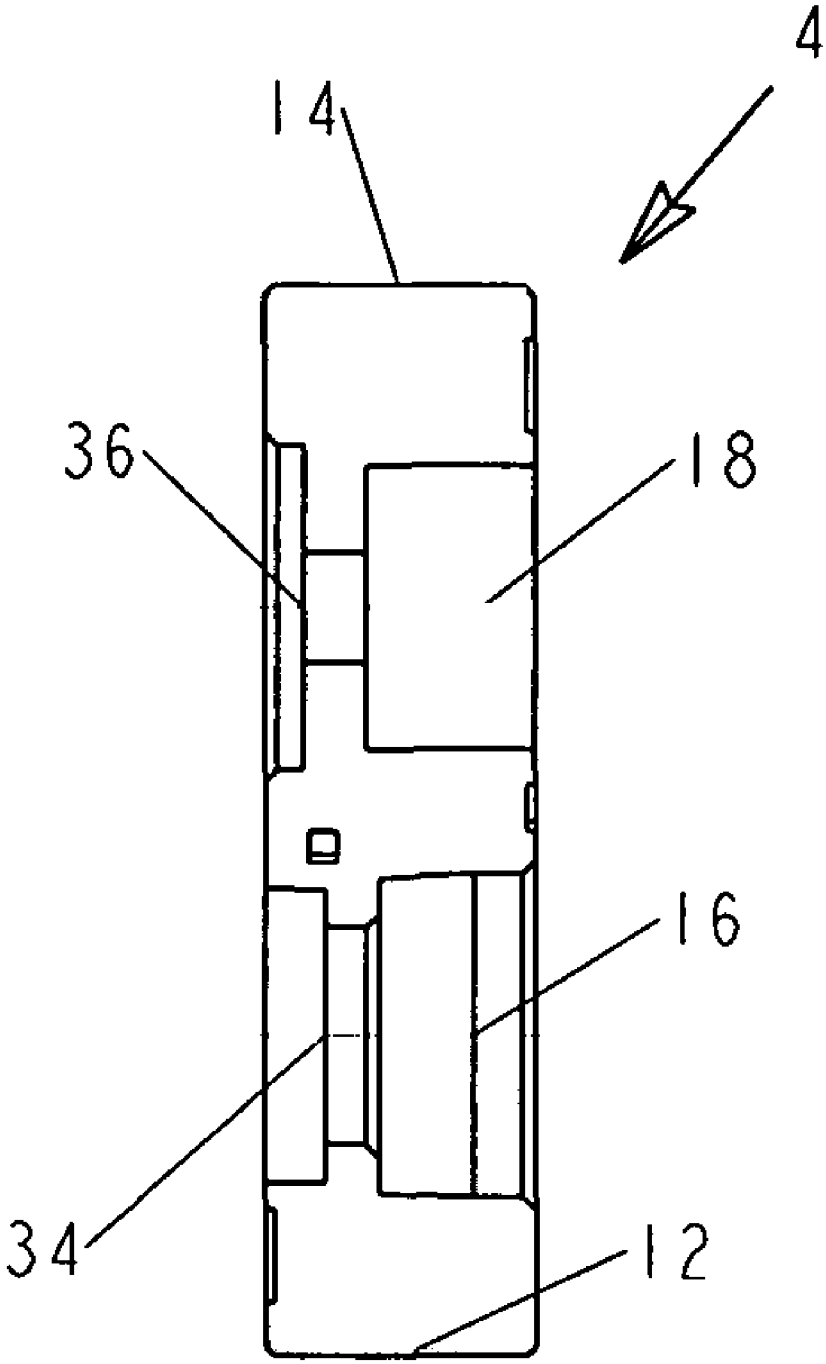
FIG. 5E is a sectional side view of the elongated member along the Section A-A of FIG. 5C.

FIGS. 3A to 3E show further detail of the mounting member 6. The same reference numerals are used in FIGS. 3A to 3E as those used in FIGS. 1 and 2 for those components that are identical. In FIG. 3C, it can be seen that the mounting member 6 has a circular face 29 with 6 notches 28 equally spaced around a circumference of the face 29. The second pivot axis 18 and the third pivot axis 20 prevent unwanted rotation through friction that can be overcome by manual force. The nuts 56, 62 are locking nuts that hold their position on the bolts 38, 60 respectively. Similarly, the pivot screw 46 holds the mounting member 6 against the elongated member 4 so that friction prevents the elongated member 4 from pivoting relative to the mounting member 6 even when the elongated member 4 is in the unlocked position, the elongated member 4 is able to rotate relative to the mounting member 6 about the first pivot axis 16, except when the friction is overcome by manual force.

In FIGS. 4A to 4F, there is shown further detail of the bracket 8. The same reference numerals are used in FIGS. 4A to 4F as those used in FIGS. 1 and 2 for those components that are identical.

In FIGS. 5A to 5E, there is shown further detail of the elongated member 4. The same reference numerals are used in FIGS. 5A to 5E as those used in FIGS. 1 and 2 for those components that are identical.

In operation, a user of the mouse support 2 installs the clamp 22 of the mounting member 6 on an edge (not shown) of a tabletop, computer keyboard tray or similar computer work station (not shown) and tightens the clamping nut 26 to secure the support to the work station. For right-handed users, the device will preferably be located on the right side of the work station. For left-handed users, the device will preferably be located on the left side of the work station. In order to obtain the proper alignment of the mouse support 2 with the user's mousing hand, the user applies pressure to the cap 44 sufficient to depress the cap 44 from the resting place of the cap within an arcuate notch 28 of the mounting member 6 and into the second aperture 36 of the elongated member 4. With the cap 44 depressed, the elongated member 4 unlocks, thereby enabling the user to rotate the elongated member 4 about the first pivot axis 16 of the mounting member 6. After the desired position of the elongated member 4 about the first pivot axis 16 has been achieved, the user releases the cap 44. In order to lock the elongated member so that it will not rotate relative to the mounting member 6 about the first pivot axis 16, the user must ensure that the cap 44 is released into a notch 28 of the mounting member 6. At the second pivot axis 18, the user may rotate the bracket 8 about the second pivot axis 18 of the elongated member 6. Additionally, the user may rotate the platform 10 around the third pivot axis 20. By providing a support having three pivot axes, including the third pivot axis 20, which is perpendicular to the first and second pivot axes 16,18, the user is able to rotate the platform 360 degrees about either of the horizontal axes 16,18 and about the third pivot axis 20. The orientation of the third pivot axis 20 varies as the bracket is pivoted relative to the first and second pivot axes 16,18. In this way, the user is able to adjust both the angle and height of the mousing surface on the platform 10 and can maintain the platform 10 in a horizontal orientation.

The mouse support 2 may be stored beneath the base or work station (not shown), by first depressing the cap 44 and then pivoting the elongated member 4 downward such that the platform 10 is positioned in a downwardly facing orientation. Next, the platform 10 may be pivoted about the third pivot axis 20 in the direction of the mounting member 6, such that the platform 10 is positioned beneath the lower surface of the mounting member 6. When the mouse support 2 is mounted on the edge of a keyboard tray, and the tray is in a storage position, the mouse support 2 can also be in a storage position beneath the workstation or desk to which the keyboard tray is mounted. In a first position, the third pivot axis is in a vertical position and the platform 10 is horizontal and in an upright position and, in a second position, the third pivot axis is in a vertical position and the platform is horizontal but upside down. The first position and second position are 180° apart from one another.

The adjustable mouse support 2 has a plurality of locked positions in which the elongated member 4 cannot pivot relative to the mounting member 6 and an unlocked position in which the elongated member 4 can pivot relative to the mounting member 6. The bracket 8 is able to pivot about the second pivot axis 18 relative to the elongated member 4 through infinite positions within at least a predetermined range exceeding 180 degrees and preferably a predetermined range of 360 degrees. The elongated member 4 pivots about the mounting member 6 in a vertical plane in the orientation shown in FIG. 1. The bracket 8 pivots about the elongated member 4 in a vertical plane and the platform 10 pivots about the bracket 8 in a horizontal plane. The first pivot axis 16 and the second pivot axis 18 are parallel to one another. The third pivot axis 20 is perpendicular to the first and second pivot axes 16,18.

Variations within the scope of the attached claims will be readily apparent to those skilled in the art.

The adjustable mouse support 2 has a plurality of locked positions in which the elongated member 4 cannot pivot relative to the mounting member 6 and an unlocked position in which the elongated member 4 can pivot relative to the mounting member 6. The bracket 8 is able to pivot about the second pivot axis 18 relative to the elongated member 4 through infinite positions within at least a predetermined range exceeding 180 degrees and preferably a predetermined range of 360 degrees. The elongated member 4 pivots about the mounting member 6 in a vertical plane in the orientation shown in FIG. 1. The bracket 8 pivots about the elongated member 4 in a vertical plane and the platform 10 pivots about the bracket 8 in a horizontal plane. The first pivot axis 16 and the second pivot axis 18 are parallel to one another. The third pivot axis 20 is perpendicular to the first and second pivot axes 16,18.

Variations within the scope of the attached claims will be readily apparent to those skilled in the art.

I claim:

1. An adjustable mouse support for use with a base, the mouse support comprising an elongated member, a mounting member, a bracket and a platform, said elongated member having two ends with two pivot axes thereon, said two pivot axes being a first pivot axis located near a first end of said two ends, and a second pivot axis located near a second end of said two ends, said mounting member being removably connectable to said base and being pivotally connected to said elongated member at said first pivot axis, said bracket being pivotally connected to said elongated member at said second pivot axis, said mounting member and said bracket being located at opposite sides of said elongated member, said platform being pivotally mounted on said bracket about a third pivot axis, said first and second pivot axes being parallel to one another, said third pivot axis being perpendicular to said first and second pivot axes.

2. An adjustable mouse support as claimed in claim 1, wherein said elongated member has a plurality of locked positions in which said elongated member cannot pivot relative to said mounting member about said first pivot axis and an unlocked position in which said elongated member can pivot relative to said mounting member.

3. An adjustable mouse support as claimed in claim 2, wherein said first and second bolts prevent unwanted rotation in said second and third pivot axes respectively through friction that can be overcome by manual force.

4. An adjustable mouse support as claimed in claim 2, where said first pivot axis and said second pivot axis are horizontal, said third pivot axis being vertical when said platform is horizontal.

5. An adjustable mouse support as claimed in claim 2, wherein said bracket is able to pivot about said second pivot axis relative to said elongated member through infinite positions, within at least a predetermined range, exceeding 180 degrees.

6. An adjustable mouse support as claimed in claim 5, wherein each pivot axis allows pivoting through 360 degrees.

7. An adjustable mouse support as claimed in claim 2, wherein said mounting member has a circular face with a plurality of notches peripherally spaced about a circumference thereof, said face being adjacent to said elongated member and being centred on said first pivot axis, said elongated member having a movable projection thereon that is sized and shaped to fit within one of said notches.

8. An adjustable mouse support as claimed in claim 7, wherein a first bolt extends along said second pivot axis, said first bolt having a head with a spring loaded cap thereon, said elongated member being unlocked relative to said mounting member when said cap is depressed against said spring.

9. An adjustable mouse support as claimed in claim 7, wherein a first bolt extends between said elongated member and said bracket along said second pivot axis, said movable projection being a spring-loaded cap located on said first bolt, said cap being sized and located to fit within one of said notches, there being a spring located between said cap and said elongated member, said cap being depressible against a force of said spring toward said elongated member remove said cap from said one of said notches and to place said elongated member in said unlocked position allowing said elongated member to pivot relative to said mounting member about first pivot axis, said cap being releasable to cause said cap to be located within any one of said notches, thereby returning said elongated member to one of said plurality of said locked positions.

10. An adjustable mouse support as claimed in claim 9, wherein said cap is centered on said second pivot axis.

11. An adjustable mouse support as claimed in claim 10, wherein said first bolt that extends along said second pivot axis has a head located thereon in said elongated member and said cap is centered on said head with said spring being located between said cap and said head.

12. An adjustable mouse support as claimed in claim 9, wherein there are six notches equally spaced around said circumference of said face.

13. An adjustable mouse support as claimed in claim 12, wherein said elongated member is in said locked position when said spring is in an unloaded position and said cap rests within one of said arcuate notches of said mounting member.

14. An adjustable mouse support as claimed in claim 12 wherein said elongated member has a first aperture which defines said first pivot axis and a second aperture which defines said second pivot axis, said first aperture being sized to receive a first pivot screw rotatably inserted through said first aperture into said face of said mounting member along said first pivot axis.

15. An adjustable mouse support as claimed in claim 14, wherein said face has a cylindrical portion extending outward therefrom into said first aperture which is sized to receive said cylindrical portion, said first pivot screw extending into said cylindrical portion.

16. An adjustable mouse support as claimed in claim 15, wherein said elongated member has a rang of movement about said first pivot axis of 360 degrees when said elongated member is in said unlocked position.

17. An adjustable mouse support as claimed in claim 1, wherein a second bolt extends along said third pivot axis, said second bolt defining said third pivot axis, said second bolt rotatably inserted through said platform into said bracket, said mouse support being rotatable about said third pivot axis through 360 degrees.

18. An adjustable mouse support for use with a base, the mouse support comprising an elongated member, a mounting member, a bracket and a platform, said elongated member having two ends with two pivot axes thereon, said two pivot axes being a first pivot axis located near a first end of said two ends, and a second pivot axis located near a second end of said two ends, said mounting member being removably connectable to said base and being pivotally connected to said elongated member at said first pivot axis, said bracket being pivotally connected to said elongated member at said second pivot axis, said first pivot axis and said second pivot axis being parallel to one another and being horizontal, said platform being pivotally connected to said bracket about a third pivot axis that is vertical when said platform is horizontal, said elongated member and said bracket being sized so that said platform can pivot through a vertical plane extending between said bracket and said elongated member when said third pivot axis is vertical in a first position when said platform is upright and horizontal and is in a second position when said platform is upside down and horizontal, said first position and said second position being 180° apart from one another.

19. An adjustable mouse support as claimed in claim 18, wherein said platform can pivot through said vertical plane about said third pivot axis.

20. An adjustable mouse support as claimed in claim 19, wherein said elongated member has a plurality of locked positions in which said elongated member cannot pivot relative to said mounting member about said first pivot axis and an unlocked position in which said elongated member can pivot relative to said mounting member.

* * * * *